United States Patent [19]

Keeney

[11] Patent Number: 4,505,041

[45] Date of Patent: Mar. 19, 1985

[54] PERSPECTIVE DRAWING TEMPLATES

[76] Inventor: Bill H. Keeney, 10946 Bloomfield St., No. Hollywood, Calif. 91602

[21] Appl. No.: 381,956

[22] Filed: May 25, 1982

Related U.S. Application Data

[63] Continuation of Ser. No. 206,693, Nov. 14, 1980, abandoned.

[51] Int. Cl.[3] ..... B43L 13/14

[52] U.S. Cl. ..... 33/1 K; 33/1 B; 33/432; 33/476

[58] Field of Search ..... 33/1 K, 432, 474, 476, 33/174 B, 1 B

[56] References Cited

U.S. PATENT DOCUMENTS

| | | | |
|---|---|---|---|
| 1,723,517 | 8/1929 | McFadden | 33/474 |
| 2,933,818 | 4/1960 | Palmer | 33/174 B |
| 3,358,916 | 12/1967 | Suto | 33/432 |

FOREIGN PATENT DOCUMENTS

| | | | |
|---|---|---|---|
| 379984 | 9/1923 | Fed. Rep. of Germany | 33/1 K |

OTHER PUBLICATIONS

Graphic Indicator Co. Inc., Third Edition, Cassel Perspective Indicator Work Sheet #42 Undated.

*Primary Examiner*—William D. Martin, Jr.
*Attorney, Agent, or Firm*—Frank L. Zugelter

[57] ABSTRACT

A drafting template having printed thereon a pattern of non-concentric elliptical portions, preferably forming complete ellipses, a vertical measuring line extending upwardly from a common point for the pattern or from a base point for the vertical measuring line, and a horizon line mounted at a scaled height above the base point and being parallel to the major axes of the elliptical portions or ellipses. The pattern is a perspective view of concentric circles or portions thereof taken at a scaled distant station point and scaled height above the plane for the circles. The horizon line is mounted at a scaled height above the base point. By selecting one or more vanishing points on the horizon (line), and drawing lines on an overlaying drafting sheet correlated to the base point between the vanishing point(s) and base point, such drawing lines intersecting the elliptical portions or ellipses, a lined grid field can be ultimately produced on the drafting sheet. It is from this grid field that a visually accurate perspective view of an area can be structured. A wide variety of series of templates including different scales and different values for the parameters of the template can be produced.

20 Claims, 10 Drawing Figures

FOR ¼" INCH SCALE ON TEMPLATE

| STATION POINT DISTANCE (IN FEET) | VANISHING POINT SEPARATION DISTANCE (IN INCHES) |
|---|---|
| 8 | – |
| 12 | 7 |
| 18 | 9 |
| 20 | 11 |
| 24 | 13 |
| 30 | 15 |
| 36 | 17 |
| 40 | 19 |
| 48 | 20 |
| 60 | 24 |
| 72 | 31 |
| 80 | 50 |
| 100 | 60 |
| 150 | 72 |

| AREA IN SQUARE FEET (a) | TEMPLATE (t) | VANISHING POINTS (INCHES) (v) |
|---|---|---|
| 10-100 | 1 | 13" |
| 100-200 | 2 | 17" |
| 200-500 | 3 | 20" |

71

| TEMPLATE | STATION POINT DISTANCE IN FEET | VANISHING POINTS IN INCHES |
|---|---|---|
| 1 | 20' | 11" |
| | *24' | 13" |
| | 30' | 15" |

72

PERSPECTIVE DRAWING TEMPLATES

This is a continuation application of Ser. No. 06/206,693, filed Nov. 14, 1980, now abandoned.

TECHNICAL FIELD

This invention relates to a manufacture for the preparation of a perspective drawing, and more particularly, is directed to a template that facilitates accurate two-point and one-point perspective drawings of perspectively-viewed areas.

Perspective drawings are established as aids and effective tools in design processes used by architects and interior designers. A perspective drawing is used in a design process itself to show scale and proportions of articles, rooms, buildings, and spaces open and closed by and to one who is viewing the perspective-field area comprising such tangible and intangible elements. Such a drawing is also used in the production of a detailed rendering showing an artist's concept of a planned space.

PROBLEMS IN THE PRIOR ART

Considerable difficulty is encountered by architects and designers in constructing visually accurate perspective grids on a drafting sheet and which forms the underlying structure or lined grid system on or from which a presentation of a perspective drawing eminates. The problem of producing a perspective drawing is reduced by use of commercially-available pre-printed grid field sheets, which are easy to use and require little preparation. One example is the Cassel Perspective Indicators (work sheets) made and sold by Graphic Indicator Co., Inc., P.O. Box 96, La Habra, Calif. 90631. However, the fixed vanishing point and the fixed station point of pre-printed grid system sheets are serious limitations towards effecting a completed and accurate perspective drawing, due to the fact that the presently available grid field field sheets do not provide any flexiblity of change of position for either the vanishing or station point.

One purpose of a perspective drawing is to produce in a single drawing the appearance of a space or article(s) as seen by normal human vision from a particular viewing station point. In a perspective drawing (a two-dimensional sheet), were two parallel lines from such space or article(s) extended to meet at a vanishing point (in the sheet itself) at infinity or on the horizon, such space or article(s) would become foreshortened in their dimensions and smaller to one's vision were they to recede in location towards the horizon in the sheet. A difficulty in producing a perspective drawing on a sheet is locating a proper vanishing point on a proper horizon for such parallel lines to the scale of the drawing and thereby establish an accurate lined-grid field on which the perspective drawing itself can be structured or formed.

In order to construct a perspective drawing, resort is made to use of one of the standard and known construction procedures, which is time consuming, tedious and often requiring revisions. The methods of these procedures usually require the locating of two additional "measuring points" and two "horizontal measuring scales", from which a lined-grid field or system is then constructed. This is a trial-and-error technique, even by an experienced designer/delineator. Of course, where accuracy is not essential, a designer may use a simple sub-dividing method on a sheet for an arbitrary space, in order to obtain a workable grid. But such a method at best only approximates an actual perspective field which otherwise could correctly and accurately delineate a measureable space.

Furthermore, the present state of the art requires the construction of a suitable grid system consisting of a series of steps to establish vanishing points, measuring points and projections through horizontal measuring scales. Such a construction is at best a close approximation to an accurate visual measureable space or view.

DISCLOSURE AND SUMMARY OF THE INVENTION

An object of this invention is to facilitate the preparation of visually accurate perspective grid or grids and their systems, together with a drawing therefrom.

Another object of this invention is to provide a drawing template for the preparation and construction of visually accurate perspective grids and grid systems, and drawing therefrom.

A further object of this invention is to provide a template easy and accurate to use in the facilitation and preparation of perspective grids and grid systems, and drawing therefrom.

Yet another object of this invention is to provide an instrument facilitating the production of a perspective drawing by presenting sufficient information or data in easy-to-read form.

Another object of this invention is to provide a simple, inexpensive, and easy-to-fabricate template which produces a perspective drawing from any one of an indefinite number of viewing station points and from any one of an indefinite number of horizons or horizon lines.

A further object of this invention is to provide knowledge of data and how to obtain same so that such data on the parameters for the elements of the template can be utilized to produce a wide variety of series of templates.

Another object of this invention is to provide a template for which vanishing points and viewing stations are not fixed at particular geometrical points of the two-dimensional template, but rather have the flexibility of change of position for the template.

These and other objects of the invention will become more apparent by a reading of the following description, appended claims thereto and the accompanying drawing comprising four sheets of drawing.

DESCRIPTION OF THE PREFERRED EMBODIMENT(S)

Best Mode(s) of Carrying Out the Invention

Figure 3:
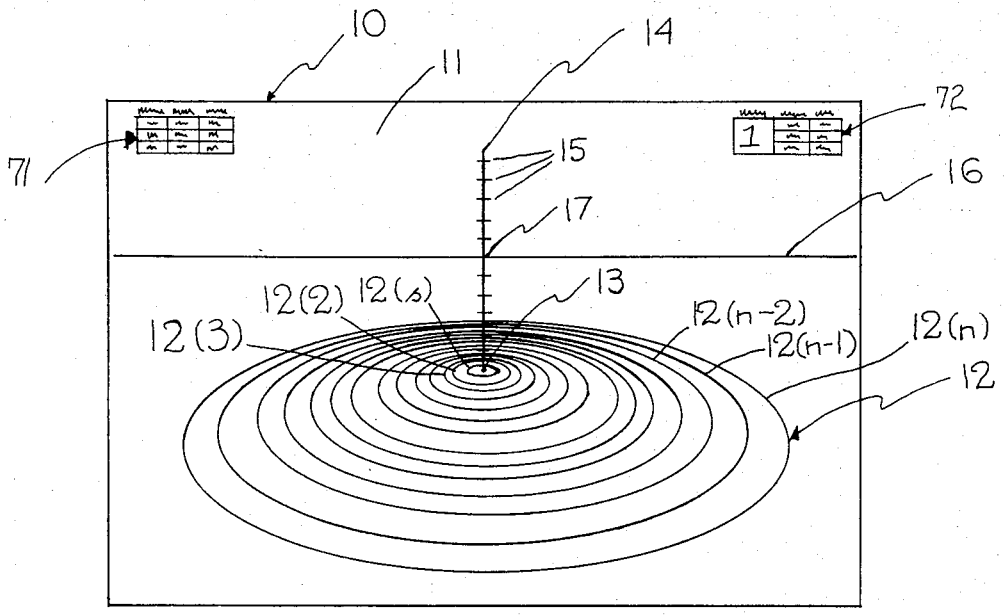
FIG. 3 is a plan view of a composite template embracing the forms shown in FIGS. 1 and 2.

Referring now to the drawing in which reference characters therein correspond to like numerals hereinafter, a template 10 is shown in FIG. 3, and comprises a sheet 11 of material suitable in size and known nature, such as Vellum or mat Mylar, for drawing table purposes. A plurality or pattern of true ellipses 12(*s*), 12(2), 12(3), . . . , 12(n−2) 12(n−1), 12*n* are non-concentrically mounted or imprinted on sheet 11, "n" identifying the largest ellipse for a given-sized template 10, the "s" identifying the smallest ellipse mounted on sheet 11; the other intermediate numerals identifying in progressive manner, from the smaller to the larger, the remaining ellipses from 12(*s*) to 12(*n*). Pattern 12 is arranged about a base point 13 included in template 10 and which lies centrally of the smallest ellipse 12(*s*), i.e., substantially midway the length of its major axis (not shown). Preferably, the major axes (not shown) of the ellipses are disposed in horizontal fashion, i.e., across the width of sheet 11. The major axis of each of the ellipses included in sheet 11 is not superimposed on the major axis of any other ellipses of pattern 12, rather, these major axes are substantially parallel one to another.

Figure 1:
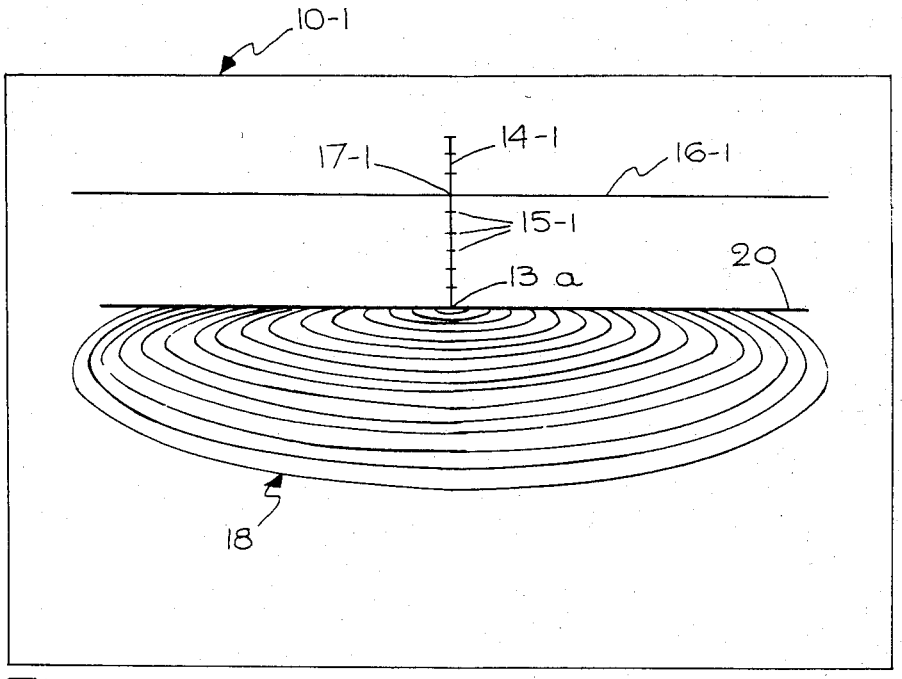
FIG. 1 is a plan view of a template embodying one form of my invention.
Figure 2:
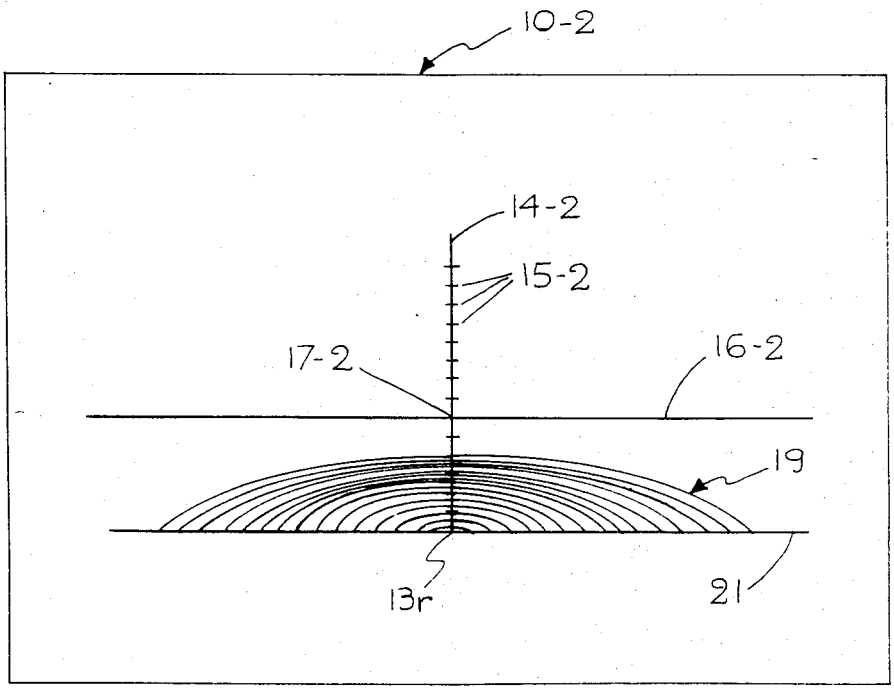
FIG. 2 is a plan view of a template embodying another form of my invention.

Each of these ellipses in pattern 12, as well as those in the elliptical patterns of FIGS. 1 and 2, is true, i.e., having its parameters developed, calculated or otherwise determined along principles of analytical geometry, although the patterns' appearances provide a viewer with a visual impression of concentric circles seen in perspective and being mounted about a common center.

A line 14 is mounted or imprinted on sheet 11 in operative relationship or connection to base point 13, providing a means to initially orient a drafting sheet overlie to template 10. This relationship is shown here by its intersection with base point 13 and its upward direction in vertical fashion therefrom, substantially perpendicular to the major axis of ellipse 12(*s*). A plurality of markings 15 for indicating scaled successive units of uniform linear measurement is struck or imprinted across line 14. Line 14 hereinafter is referred to as the VML or vertical measuring line. The VML need not be physically connected to base point 13, however, its loci of points wherever they lie above such point 13 do geometrically pass through such base point.

A horizon line 16 is mounted or imprinted on template 10 and is likewise operatively connected to base point 13 which serves as a point in the plane of ground level for the grid or field to be developed. Horizon line 16 preferably extends substantially across the width of template 10, and crosses the VML at a desired height above base point 13, such as at a particular marking 17. Line 16 is disposed substantially parallel to and spaced from the major axes of the pattern's ellipses, and represents the infinite distance or loci of points along which parallel lines drawn from an article in a perspective view vanish to the eyes of a viewer looking at a completed perspective drawing.

It should be understood that in the manufacturing of a template 10 [or of template 10-1, 10-2 of FIGS. 1 and 2], although the preferred embodiment includes as part thereof all the aforesaid described elements of template 10, any one or number of these elements can be omitted in such manufacturing and added during actual use of the invention. I.e., any one of the elements 13, 14, 15, 16, 17, singly or in combination with one or more, need not be included in the manufactured template, but rather added either to a template carrying the pattern 12 [or corresponding pattern shown in FIGS. 1, 2] or to a drafting sheet overlying such a template, in the use of the invention. This will become apparent by a reading of the description hereinafter showing how the invention is used.

FIG. 3 is a composite of templates 10-1 and 10-2 of FIGS. 1 and 2, respectively. Were the elliptical portions of partial pattern 18 of ellipses of FIG. 1 to extend fully around its base point 13*a* (to return upon themselves), they would superimpose themselves on the elliptical portions of the partial pattern 19 of ellipses of FIG. 2. Likewise, were the portions of pattern 19 of FIG. 2 to extend fully around its base point 13*r* (to return upon themselves), they would superimpose themselves upon the portions of pattern 18 of FIG. 1.

It may be noted that a horizontally-disposed line 20, 21 in FIGS. 1 and 2, respectively, is mounted or imprinted across termini of the geometrical curvatures forming the respective elliptical portions of patterns 18, 19 shown in these two FIGURES, whereas, no such line is shown in composite view FIG. 3. Each of such lines 20, 21 simply represents the joint line between a floor and a wall and which would be seen in a completed or finished perspective drawing. It will become apparent hereinafter that such a line 20, 21 is not essential to every form or embodiment of the invention, and is not necessary in the composite of FIG. 3, although such a line could be included therein, or added thereto or to a drafting sheet in the operation or use of the invention.

The pattern 12 of ellipses in FIG. 3 and the patterns 18, 19 shown in FIGS. 1 and 2 radiate from their respective base points 13, 13*a*, 13*r*. Each of these points 13, 13*a*, 13*r* is central to its elliptical pattern and each represents a "zero" mark of the VML, or of lines 14, 14-1, 14-2, of each of the corresponding templates, 10, 10-1, 10-2. The "zero" mark with line 14, 14-1, or 14-2 assures proper orientation and provides a means to orient or correlate a template to its overlaid drafting sheet.

A horizon line 16-1, 16-2 is included or imprinted in templates 10-1, 10-2, respectively, in the same manner as line 16 is in template 10 of FIG. 3. VML's 14-1, 14-2 are mounted or imprinted in the same way on their corresponding templates as the VML is mounted or imprinted on template 10, and include corresponding markings 15-1, 15-2. Likewise, the lower terminus for each line 14-1, 14-2 occurs, preferably as shown, at the base point 13*a*, 13*r*, respectively.

Figure 4:
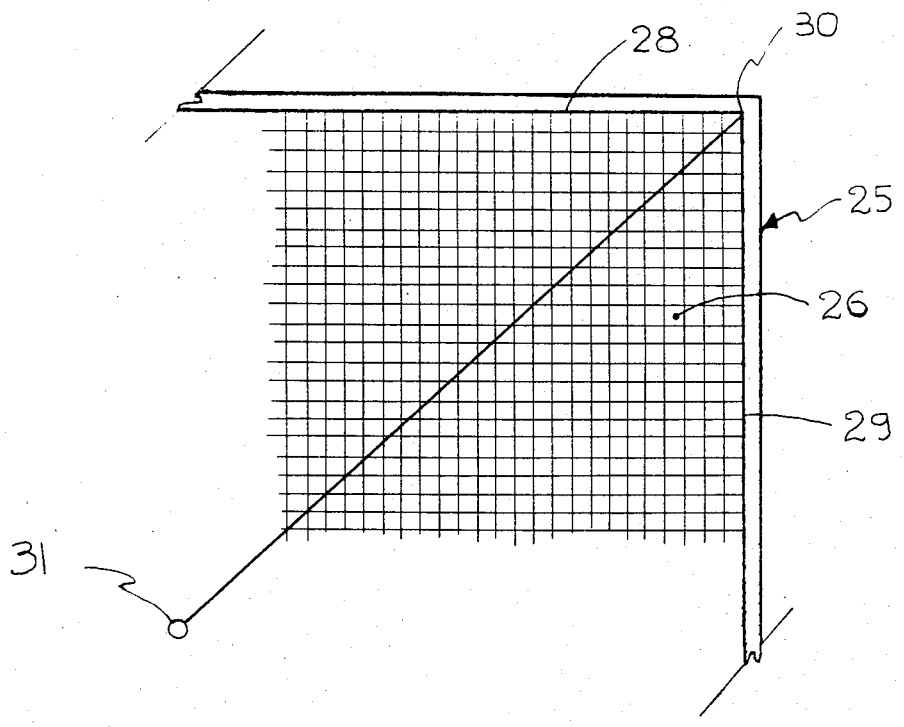
FIG. 4 is a fragmentary plan view of a typical or representative engineering drawing depicting data utilized for constructing an accurate grid scheme or system with my template.

The operation or use of the invention can be understood by referring to FIGS. 4–10, incl., in addition to FIGS. 1–3, with the following description. A plan view 25 of FIG. 4 is selected from a scaled engineering drawing and from which an area 26 is to be drawn in perspective. Area 26 is shown in typical two-dimensional scheme. Element 26 is bounded by walls 28, 29 joined together at 30. It should be understood that boundaries other than structural wall limitations may be chosen. A "zero" mark for a VML of the template to be used is chosen, and here, joint 30 is chosen to be such "zero" mark. Next, a station point 31 is selected. It is this station point 31 from which one will be viewing the finished perspective view that will be developed as a result of use of this invention.

Figures 5, 6, 9, 10:
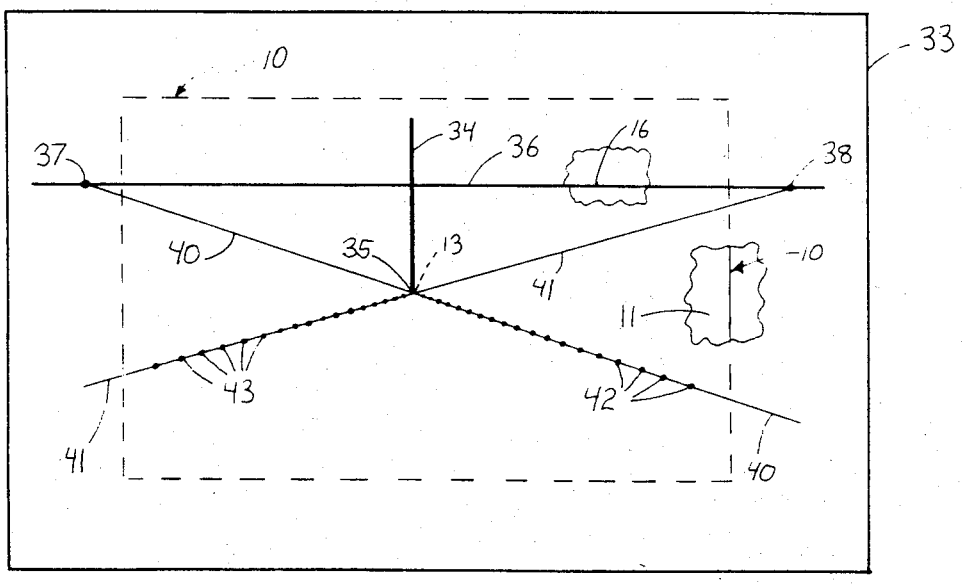
FIG. 5 is a table developed as part of my invention, listing vanishing point separation distances in relation to corresponding station point distances.
FIG. 6 is a plan view of my invention in use, as an underlay to a drafting sheet on which the perspective view is to be produced.
FIGS. 9 and 10 are magnified views of components of the template shown in FIG. 3.

The lineal distance for or in the perspective view is now established in scaled terms, by the selection of "zero" mark 30 and station point 31. In this illustration it is taken as thirty feet, obtained from the scale of the engineering drawing itself. The table of FIG. 5 is resorted to for determining a distance which separates the extreme lateral positions of the perspective view's vanishing points on the horizon at such positions. The correlation of corresponding values of the two columns of the table is described hereinafter. Each "vanishing point" is that point on the horizon of a perspective view where parallel lines from an article or the like in the view extended to the horizon meet at a point where thereafter they vanish (namely, at infinity). So here we find a range of 15 inches available along the horizon (line) between two vanishing points situated at extreme lateral positions for the perspective view, with the station point being 30 feet from the "zero" mark of the VML, and which corresponds to a ¼ inch template scale that is referenced to "picture plane" dimensions obtained during the procedure for correlating the above noted separation distances and vanishing point ranges set out in the table of FIG. 5, and which procedure is described hereinafter.

Template 10 is overlaid by a drafting sheet 33, FIG. 6, which is suitable, and in known practice, transparent in order that the aforesaid elements of template 10 can be seen. A vertical line 34 is drawn on drafting sheet 33, being superimposed upon the VML of template 10. The "zero" mark of template 10, which as a practical matter is its base point 13, is correlated to the bottom terminus 35 or other point of vertical line 34. A line 36 is drawn on sheet 33, being superimposed on horizon line 16 of template 10. Line 36 is scaled six feet above the "zero" mark 35 or ground level of the VML for template 10, in this particular illustration of use of the invention.

Next, two "vanishing points" separated by 15 lineal inches on sheet 33 along line 36 are selected. This 15-inch separation distance is selected by shifting to the right or to the left along line 36 such distance to gain what desired effect the designer has in mind for this particular perspective. Once the two vanishing points 37, 38 are selected on line 36—and it is to be noted that both points 37, 38 may lie either within or without or outside the physical boundaries of template 10 or one or the other within such physical boundaries of template 10—each of these points together with the "zero" mark of the VML, or point 35 on sheet 33, provide the geometrical basis for drawing (ground) lines 40, 41 on sheet 33. Lines 40, 41 appear to intersect, pointwise, each of the ellipses in pattern 12 in the underlaying template 10. 'tic' marks 42, 43 are ticked off on sheet 33 with pencil at each of these intersecting points (FIG. 6).

Figure 7:
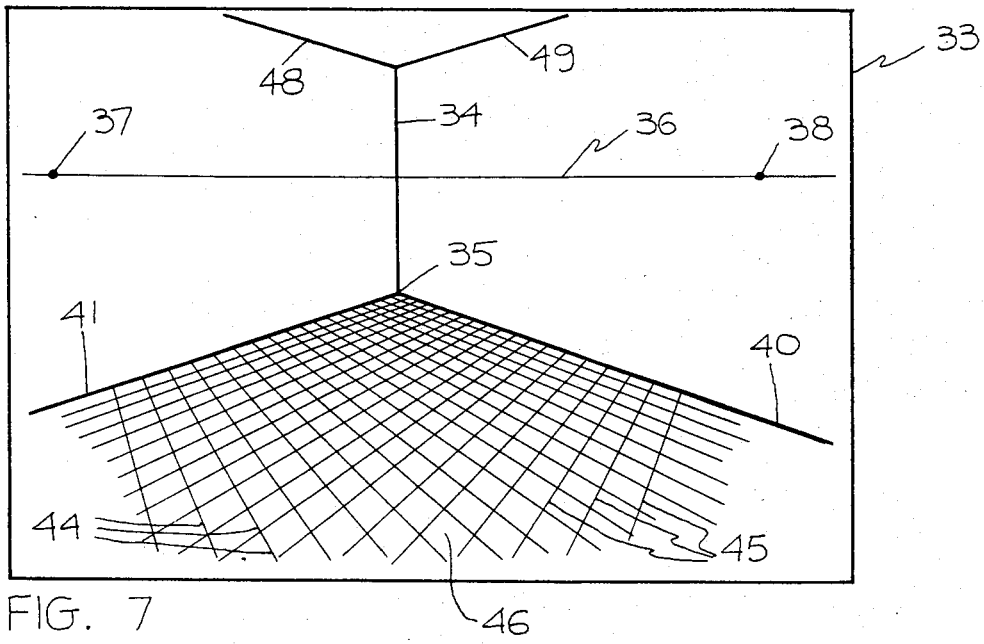
FIG. 7 is a plan view of a drafting sheet having thereon a grid system developed by reason of use of my invention, using a two-point perspective approach.

Next, a straight edge (not shown) is used across vanishing point 37 and 'tic' marks 43 to produce by pencilling grid lines 44, FIG. 7, and likewise, a straight edge is used across vanishing point 38 and 'tic' marks 42 to produce by pencilling grid lines 45.

Thus, a grid system 46 has been developed, shown in FIG. 7, for the field area sought for the perspective view that can now be structured accurately on such system 46.

It is now apparent, too, that the front half only of template 10 has been utilized in establishing system 46. Thus, template 10-1, had it been used, would have served the same purpose for developing system 46. In this regard, it may be noted that grid system 46 developed in FIG. 7 for area 26 is one which approaches or advances towards the viewer at station point 31. It becomes apparent that had area 26 been one which receded away from the 'zero' mark of the VML, or point 35, sometimes called the "airplane view", the same procedure would be used. However, the position of the developed grid system would lie on sheet 33, FIG. 6, between the portions of the lines 40, 41 on which no 'tic' marks appear. I.e., the 'tic' marks 42, 43 would rather appear on the portions of lines 40, 41 that are directed from point 35 upwardly to intersect at 37, 38 on line 36. In this case, template 10-2 would serve the purpose.

Lines 48, 49, FIG. 7, are now drawn in on sheet 33, and are geometrically keyed to the vanishing points 38, 37, respectively, by being linear extensions therefrom. They are included here in an exemplary manner, illustrating ceiling heights along scaled line 34, should engineering drawing 25 have been, say, a plan view of a room with a known ceiling height.

Figure 8:
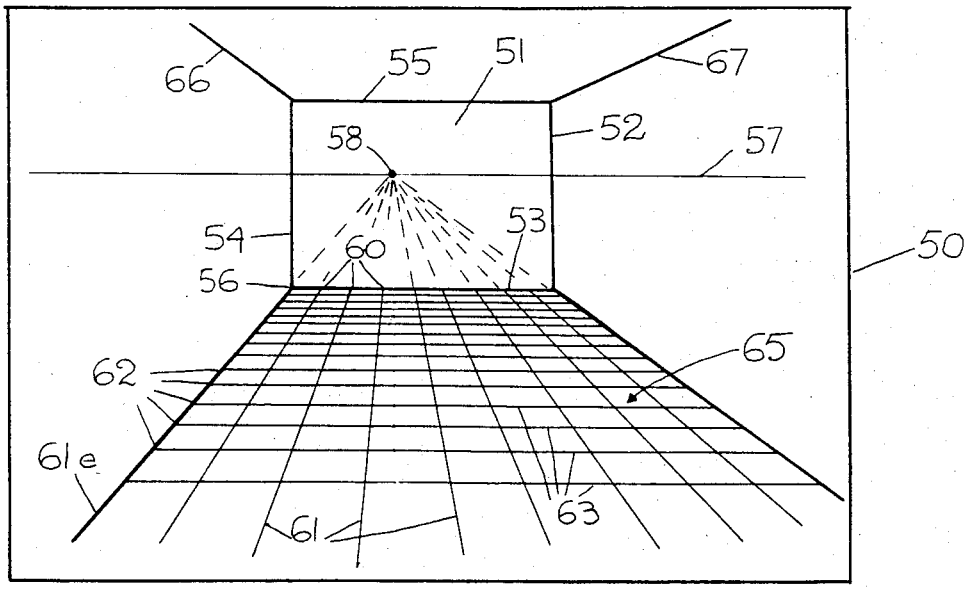
FIG. 8 is a plan view of a drafting sheet having thereon a grid system developed by reason of use of my invention, using a one-point perspective approach.

With regard to development of a "one-point" perspective grid system, i.e., using but one "vanishing" point on the horizon, referring to FIG. 8, a sheet 50 overlays anyone of the templates 10, 10-1, 10-2 (not shown). The first step is to scale draw, say, a back wall 51 for a room and comprising lines 52, 53, 54, 55. The template used is so underlaid that either the right or left lower corner of the drawn wall 51 is superimposed on the "zero" mark of the VML of the template, and either line 52 or 54 superimposed on the VML. Here, line 54 is superimposed on the VML, with its bottom terminus 56 superimposed on the 'zero' mark. Next, line 57 is drawn on sheet 50, superimposed on the horizon line of the underlaid template, and a single vanishing point 58 is selected on line 57; here, to the left of center of the wall. 'Tic' marks 60 are made on sheet 50 at scale unit distances of wall 51, here, along line 53. Thereafter, a straight edge, set between vanishing point 58 and each of the 'tic' marks on scaled line 53, and pencil produce a set of grid lines **61, 61*e*. Again, elsewhere along the portions of the elliptical pattern of the underlaid template, the appearance of intersectional points occurs between such portions and the drawn line 61*e* on sheet 50. 'Tic' marks 62 are made on sheet 50 at these intersections and thereafter grid lines 63 are drawn across sheet 50, as shown, parallel to line 53. Thus, a lined grid field 65** is produced.

It may be noted, although not shown in FIG. 8, that 'tic' marks of scaled unit distances could be made along the scaled line 54, to thereby provide the basis for an accurate vertical perspective for things to be seen in a finished perspective view.

Lines 66, 67 are added by being geometrically keyed to vanishing point 58, i.e., drawn along a straight edge setting between point 58 and each of the upper termini of wall lines 52, 54, respectively.

As can be seen, the result is an accurately developed grid system 65 on which a perspective view can now be accurately structured.

Either template 10 or 10-1 produces FIG. 8. The use of template 10-2 makes wall 51 a frontal or forward wall of a room in perspective, and a grid system developed with the use of template 10-2 would lie in FIG. 8 along the dashed or phantom lines projecting back to vanishing point 58 from line 53 as seen in FIG. 8.

The elliptical pattern for template 10 is produced by the following procedures. A series of concentric circles is drawn with a felt-tip pen on a piece of flat plywood. Using a rigid molding strip as a radius and having holes located at 1-inch centers from one another, the felt-tip pen in each hole circumscribes a circle on the plywood, each circle being at a 1-inch interval from the next, as the radius strip is held to and drawn around the plywood's center point. Let each 1-inch interval represent one real foot. The plywood with the circles is then placed in horizontal disposition. A 35-mm single lens reflex camera, using a 20-mm lens, is used to photograph this construction and setting. The focal plane for the film in the camera is placed at a real distance in inches, simulating a particular station point distance in feet, from the center point of the plywood or common center of the circles, and the center of the lens is placed at six inches in real distance above the plane of the plywood (parallel to the plane of the circle or plywood). The six inches represents a six-foot height at which a horizon line for a given template is to be disposed. A photograph is taken, producing on film a perspective view of such circles, which of course are now seen in ellipses. The film developed from this shooting is blown up into a 16"×20" print.

With high resolution photography presently available today, the above steps can also be carried out with a suitable type of camera producing high resolution for the ellipses on the film. Thereafter, actual measurement of the dimensions and relationships of the ellipses are lifted off of such a print. This data is transformed or translated into artwork preparatory to printing of the template in accordance with known printing processes. One or more of the elements 13, 14, 15, 16, 20, 21 of the template, if so desired, is introduced into such artwork prior to printing of the template.

A computer and pen-plotting machine also can be utilized in producing correct patterns of ellipses for such artwork of printing processes. For example, with the camera and steps noted above, the following procedure is available. Measurements are taken, on the print, of the minor axis of each of the ellipses shown. These minor axes are coincident to a vertical line drawn through the common center of the concentric circles but which now can be perceived as the same as base point 13 and readily ascertained as a point on the blown-up print. The length of the portion of each minor axis that lies above this point in the print (a shorter length) is measured, and the length of the portion of each minor axis that lies below this point in the print (a greater length) is measured. A ratio of these lengths for each minor axis is then arithmetically calculated. These ratios are then introduced into a general purpose digital computer, such as model IBM 3033, made and sold by IBM Corporation, Old Orchard Road, Armonk, N.Y. 10504. The nature of this computer provides first for a "tipping back", so to speak, in the computer of a plane containing generated concentric circles simulated one foot apart, along the plane's lower edge, so that then a pattern of ellipses is generated or developed in the computer. Then, the ratio data described above is fed into the computer, so that it instructs the generated ellipses to have the same patterns that are in the print from which the ratios were taken. A pen-plotting machine or device, such as model CAL COMP 936, made and sold by Cal-Comp Corporation, 2411 West La Palma Ave., Anaheim, Calif. 92801, is operatively connected to such computer. It draws on paper what the computer tells it to do, namely the pattern of ellipses having the ratio parameters indicated. Artwork can thence be readily prepared from the pen-plotting machine's design of elliptical patterns, adding one or more of the elements 13, 14, 15, 16, 20 and 21 if desired to the artwork preparatory to printing steps.

It should now be apparent that the patterns of FIGS. 1 and 2 are obtained simply by cutting in half the pattern printed by the pen-plotting machine, and thereafter adding what other elements for these templates that are desired, to complete the artwork.

And it should also be apparent that templates having different station points and horizon line parameters can be made, by photographing the concentric circles on the plywood at differing heights and distances (simulating feet or other unit of measurement) from the horizontal plane for the concentric circles and the vertical plane carrying the center point of such circles on the plywood, respectively.

The values set forth in the two columns forming the table of FIG. 5 were obtained through methods of visual measurements, scale reductions and line projections. Take as an example the row wherein the station point distance is 30 feet from the "zero" mark of the VML. The corresponding distance separating two vanishing points on a horizon line is shown in that row to be 15 lineal inches on a drafting sheet or template. How were these values—the station point distance, horizon line height, and distance separating two vanishing points on the horizon line—established for a ¼-inch scaled template having a scaled six-foot horizon line?

A fabricated three-foot sized regular cube was set down on ground level at a distance of thirty feet from my eyes which were put at a six-foot height above ground level. I could see the top of the cube and the front or facing two sides of the cube. Also, a marker was set at six feet above ground level thirty feet from me, by the cube. A glass pane was set, in vertical disposition, at arms length from me, and through it I saw the actual cube thirty feet away. This glass pane functioned as my 'picture plane'. A 'picture plane' is the plane of a picture in a book one is looking at and which picture, say, is a perspective view of something. Taking a grease pencil, I directly superimposed on the glass pane the lines making up the cube and the marker setting thirty feet away from me, substantially as my eyes saw them. The cube and marker outlines on the glass pane became my 'picture plane' view of the actual cube and marker. I then took the glass pane to the drafting table and reduced the cube's outline and marker dimensions to a ¼-inch scale on a sheet of paper.

The two lower or bottom edges of the cube's outline now scaled on such paper were projected or extended upwardly thereon, to intersect with a line drawn horizontally across such sheet at a scaled height of six feet above the common point to the two lines forming the virtual image of the bottom edges of the front or facing two sides of the cube, such common point being coincident to the 'zero' mark for the VML of the template. Actual measurement, then, of the distance along such horizontally drawn line and between such intersections was 15 lineal inches, 7½ inches to each side of a vertical line drawn on the sheet and intersecting the horizontally drawn line, such vertical line extending upwardly from such common point (or being an extension from the line on the sheet of paper forming a virtual image of the line joining the front or facing two sides of the cube).

With the 15-inch separation distance established on the horizon line, it now is apparent that such distance can be shifted back and forth along the horizon line within reasonable spacial limits for a two-point perspective view that is to be structured upon a grid field developed on a suitably-sized drafting sheet.

These methods were utilized for determining the separation distance values for all the indicated station point distances set forth in the table of FIG. 5, and which apply to a ¼-inch scaled template having for its use a scaled six-foot horizon line from its VML. These methods are available for obtaining separation distance values at any desired station point distance, for different scaled templates and horizon lines in mind.

It should be clear now that flexibility of location of station and vanishing points are inherent to and advantageous in the use of the invention.

A unique feature of these templates is the accuracy with which a lined grid field or system is produced, simply by drawing what turns out to be a ground line, such as lines 20, 21, 40, 41, 61*e*, each of such lines being located by drawing a line passing through the 'zero' mark of the VML and one or both vanishing points on a horizon line. And therefrom, the 'tic' marks can be utilized on the drafting sheet at intersectional points formed by such lines and elliptical portions of the templates' patterns, after which lines for the grid can be drawn. The need for additional points or lines is eliminated.

Composite FIG. 3 includes illustrations of imprinted tabloids 71, 72 in the upper corners of template 10. These tabloids, magnified in FIGS. 9 and 10 to show their true fullnesses, provide data or information to a designer/draftsman as to whether a particular template of a series of templates scaled to a certain scale [e.g., ¼-inch] is suitable for a particular use in preparing a desired perspective view. In this manner, then, a particular template 10 can be selected properly for use.

Tabloid 71 comprises three columns of data, a, t, and v. For a given scaled template in a series to such a scale [scale included on each template, but not shown here], column a sets out a number of sized field areas for a particular series of templates. Column t shows which template in the series is best suited for a particular sized field area. Column v sets out the separation distance for vanishing points on the horizon line provided at a given and same height for each of the templates in the series. Such height is simply and readily known by observing on the template of a series the scaled height at which the horizon line is imprinted.

Tabloid 72 comprises three columns of data also. The first column sets out the numbered template of the series. Here in illustration, it is template "1". The second and third columns set out not only the preferred station point distance and separation distance between vanishing points for template "1", indicated by the asterick shown by the data "24" and by "13", respectively, but also provides alternative distances for station and vanishing points that could be used on this template "1". To go out side or beyond such recommended alternative parameters, a designer would select another template in the particular series, such as template "2" or template "3", etc. Template "1" would not be particularly suitable for use with parameters outside those indicated in tabloid 72.

It is now apparent that a wide variety of series of templates can be produced with knowledge of this invention, the varying of the parameters of scale, field area, station point and vanishing point separation distances, and horizon line height determining the extent of the numbers of series of templates and numbers of templates themselves in each series that can be produced.

Thus, I have invented a drafting template having imprinted thereon a pattern of non-concentric elliptical portions, preferably forming complete ellipses, a vertical measuring line extending upwardly from a common point for the pattern or base point for the vertical measuring line (VML), and a horizon line mounted at a scaled height above the base point and being parallel to the major axes of the elliptical portions or ellipses. The pattern is a perspective view of concentric circles or portions thereof taken at a scaled distant station point and scaled height above the plane of the circles. The horizon line is mounted at a scaled height above the base point. By selecting one or more vanishing points on the horizon line, and drawing lines, on an overlaying drafting sheet correlated to the base point and VML, between the vanishing point(s) and base point, such drawing lines intersecting the elliptical portions or ellipses, a lined grid field can be utimately produced on the drafting sheet. It is from this grid field that a visually accurate perspective view of an area can be structured. A wide variety of series of templates including different scales and different values for the indicated parameters for the disclosed template can be produced.

Pursuant to the requirements of the patent statutes, the invention and its principles have been explained and exemplified in a manner so that it can be readily practiced by those skilled in the art to which it pertains, such exemplification including what is considered to represent the best embodiment of the invention.

Therefore, what I claim as patentable is:

1. A template for producing a lined grid field on an overlaying drafting sheet and from which production a visually accurate perspective view is structured on the drafting sheet and comprising a sheet of material having physical boundaries, a pattern of portions on non-concentric ellipses mounted on said sheet within its physical boundaries and having a common center, a base point mounted within said physical boundaries at said common center, a vertical measuring line mounted on said sheet and being operatively connected to said base point, a horizon line mounted on said sheet and intersecting said vertical measuring line, the geometrical major axes of said ellipses being parallel to one another and spaced from said horizon line, said axes not being disposed between said base point and horizon line, whereby one or more vanishing points can be selected on said horizon line and from which with said base point ultimately produce lines forming the lined grid field.

2. The template of claim 1 wherein said portions of ellipses constitute complete ellipses.

3. The template of claim 1 wherein said pattern of portions of ellipses are mounted on said sheet of material between the geometrical axis of the smallest-sized portion of an ellipse and the horizon line.

4. The template of claim 1 wherein said pattern of portions of ellipses are mounted on said sheet of material below the geometrical axis of the smallest-sized portion of an ellipse.

5. The template of claim 3 or claim 4 wherein said portions of ellipses constitute curvatures having termini, and including a line mounted across such termini, the line being substantially parallel to the major axes of the ellipses of said portions.

6. A template for use in producing a lined grid on an overlaying drafting sheet or the like from which a visually accurate perspective view is to be structured and comprising a sheet of material having physical boundaries, a portion of an ellipse of a pattern of non-concentric ellipses mounted on said sheet within its physical boundaries and having a common center, and to which sheet one or more of the following elements are adapted either by being mounted on said sheet or by being mounted on the overlaying drafting sheet or the like a base point mounted at such common center, a vertical measuring line operatively connected to said base point, and a horizon line intersecting said vertical measuring line;

the geometrical major axes of said ellipses being parallel to one another and spaced from said horizon line, said axes not being disposed between said base point and horizon line, whereby one or more vanishing points can be selected on said horizon line and from which with said base point ultimately produce lines on the overlaying drafting sheet or the like to form the lined grid sheet.

7. The template of claim 6 wherein said portions of ellipses constitute complete ellipses.

8. The template of claim 6 wherein said pattern of portions of ellipses are mounted on said sheet of material between the geometrical major axis of the smallest-sized portion of an ellipse and the horizon line.

9. The template of claim 6 wherein said pattern of portions of ellipses are mounted on said sheet of material below the geometrical major axis of the smallest-sized portion of an ellipse.

10. The template of claim 8 or claim 9 wherein said portions of ellipses constitute curvatures having termini, and including a line adaptable for crossing such termini substantially parallel to the major axes of the ellipses of said portions.

11. The template of claim 10 wherein said line is mounted on said sheet of material.

12. The template of claim 1 or claim 7 being one of a series of templates including the elements of claim 1 or claim 8 as parameters for said series each of which parameters having at least one distinct value over like parameters for the same template in said series, based on a particular scale for said series of templates.

13. The template of claim 12 wherein said series of templates is one of a plurality of series of templates each of said series in a plurality being of a different scale.

14. The template of claim 1 or claim 2 or claim 3 or claim 4 including markings mounted on said vertical measuring line for indicating scaled successive units of linear measurement.

15. The template of claim 5 including markings mounted on said vertical measuring line for indicating scaled successive units of linear measurement.

16. For the template of claim 6 or claim 7 or claim 8 or claim 9 markings on said vertical measuring line for indicating scaled successive units of lineal measurement.

17. For the template of claim 10 markings on said vertical measuring line for indicating scaled successive units of linear measurement.

18. For the template of claim 11 markings on said vertical measuring line for indicating scaled successive units of linear measurement.

19. For the template of claim 12 markings on said vertical measuring line for indicating scaled successive units of linear measurement.

20. For the template of claim 13 markings on said vertical measuring line for indicating scaled successive units of linear measurements.

* * * * *

UNITED STATES PATENT AND TRADEMARK OFFICE

CERTIFICATE OF CORRECTION

PATENT NO. : 4,505,041

DATED : March 19, 1985

INVENTOR(S) : Bill H. Keeney

It is certified that error appears in the above-identified patent and that said Letters Patent is hereby corrected as shown below:

Col. 11, line 23, insert a comma (,) after "like".

Col. 12, line 14, --8-- should read "7".

Col. 12, line 31, insert a comma (,) after "9".

Col. 12, line 33, insert a comma (,) after "10".

Col. 12, line 36, insert a comma (,) after "11".

Col. 12, line 39, insert a comma (,) after "12".

Col. 12, line 42, insert a comma (,) after "13".

Signed and Sealed this

*Sixteenth* Day of *July 1985*

[SEAL]

*Attest:*

DONALD J. QUIGG

*Attesting Officer* *Acting Commissioner of Patents and Trademarks*